US010399367B2

(12) United States Patent
Ito et al.

(10) Patent No.: US 10,399,367 B2
(45) Date of Patent: Sep. 3, 2019

(54) INK-JET RECORDING APPARATUS

(71) Applicant: Brother Kogyo Kabushiki Kaisha, Nagoya-shi, Aichi-ken (JP)

(72) Inventors: Tsuyoshi Ito, Nagoya (JP); Noriyuki Kawamata, Nagoya (JP); Takashi Omura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/113,187

(22) Filed: Aug. 27, 2018

(65) Prior Publication Data

US 2019/0054748 A1 Feb. 21, 2019

Related U.S. Application Data

(63) Continuation of application No. 15/457,437, filed on Mar. 13, 2017, now Pat. No. 10,071,571, which is a (Continued)

(30) Foreign Application Priority Data

Nov. 28, 2011 (JP) ..... 2011-259605

(51) Int. Cl.
*B41J 11/00* (2006.01)
*B41J 13/02* (2006.01)
(Continued)

(52) U.S. Cl.
CPC ..... *B41J 13/02* (2013.01); *B41J 3/60* (2013.01); *B41J 11/0005* (2013.01);
(Continued)

(58) Field of Classification Search
CPC combination set(s) only.
See application file for complete search history.

(56) References Cited

U.S. PATENT DOCUMENTS 5,874,979 A 2/1999 Ohyama
6,616,361 B2 9/2003 Sugiyama
(Continued)

FOREIGN PATENT DOCUMENTS

JP H10-071711 A 3/1998
JP H11-138923 A 5/1999
(Continued)

OTHER PUBLICATIONS

Jan. 6, 2015—(JP) Notice of Reasons for Rejection—App 2011-259605—English Translation.

*Primary Examiner* — Huan H Tran
(74) *Attorney, Agent, or Firm* — Banner & Witcoff, Ltd.

(57) ABSTRACT

There is provided an ink-jet recording apparatus including: a first transporting portion provided in a first transport path; a support member configured to support the sheet; a recording portion; a plurality of contact portions configured to come into contact with the sheet; a plurality of support ribs; a second transporting portion provided in a second transport path connected with the first transport path; and a third transporting portion configured to sandwich and transport the sheet in the first transporting direction or toward the second transport path. On the upstream side to the second transporting portion in the second transporting direction, a projecting portion is formed with the upper guide member to project toward the lower guide member below a virtual line linking a nip position of the sheet due to the third transporting portion with another nip position of the sheet due to the second transporting portion.

12 Claims, 9 Drawing Sheets

Related U.S. Application Data continuation of application No. 15/014,455, filed on Feb. 3, 2016, now Pat. No. 9,592,681, which is a continuation of application No. 14/702,942, filed on May 4, 2015, now Pat. No. 9,259,946, which is a continuation of application No. 14/190,995, filed on Feb. 26, 2014, now Pat. No. 9,022,555, which is a continuation of application No. 13/629,718, filed on Sep. 28, 2012, now Pat. No. 8,708,481.

(51) Int. Cl.

| | |
|---|---|
| ***B41J 3/60*** | (2006.01) |
| ***B41J 13/00*** | (2006.01) |
| ***B65H 5/06*** | (2006.01) |
| ***B65H 5/26*** | (2006.01) |
| ***B65H 29/58*** | (2006.01) |

(52) U.S. Cl.

CPC ..... *B41J 11/0045* (2013.01); *B41J 13/0045* (2013.01); *B65H 5/068* (2013.01); *B65H 5/26* (2013.01); *B65H 29/58* (2013.01); *B41J 11/00* (2013.01)

(56) References Cited

U.S. PATENT DOCUMENTS

| | | | | |
|---|---|---|---|---|
| 7,021,757 | B2 | 4/2006 | Kida | |
| 7,775,656 | B2 | 8/2010 | Sugiyama et al. | |
| 7,806,510 | B2 | 10/2010 | Samoto et al. | |
| 8,152,169 | B2 * | 4/2012 | Samoto | B65H 5/36 271/301 |
| 8,708,481 | B2 | 4/2014 | Ito et al. | |
| 9,022,555 | B2 | 5/2015 | Ito et al. | |
| 9,259,946 | B2 | 2/2016 | Ito et al. | |
| 9,592,681 | B2 | 3/2017 | Ito et al. | |
| 10,071,571 | B2 * | 9/2018 | Ito | B41J 3/60 |
| 2002/0067942 | A1 | 6/2002 | Sugiyama | |
| 2003/0025777 | A1 | 2/2003 | Sugiyama | |
| 2003/0048345 | A1 | 3/2003 | Matsumoto | |
| 2004/0126164 | A1 | 7/2004 | Ohyama | |
| 2005/0168557 | A1 | 8/2005 | Ohyama | |
| 2007/0146419 | A1 | 6/2007 | Samoto et al. | |
| 2007/0176996 | A1 * | 8/2007 | Yoshida | B41J 3/28 347/104 |
| 2009/0085949 | A1 | 4/2009 | Sugiyama et al. | |
| 2010/0207321 | A1 | 8/2010 | Samoto et al. | |
| 2011/0001778 | A1 | 1/2011 | Kanda et al. | |
| 2011/0103867 | A1 | 5/2011 | Iijima | |
| 2013/0135389 | A1 * | 5/2013 | Ito | B41J 11/005 347/37 |
| 2013/0135393 | A1 * | 5/2013 | Samoto | B65H 5/062 347/47 |
| 2013/0135409 | A1 | 5/2013 | Ito et al. | |
| 2013/0135413 | A1 * | 5/2013 | Ito | B41J 11/06 347/104 |

FOREIGN PATENT DOCUMENTS

| | | | |
|---|---|---|---|
| JP | 2000-071532 | A | 3/2000 |
| JP | 2010-208853 | A | 9/2010 |
| JP | 2011-093674 | A | 5/2011 |

* cited by examiner

INK-JET RECORDING APPARATUS

CROSS REFERENCE TO RELATED APPLICATION

The present application is a continuation of U.S. application Ser. No. 15/457,437 filed Mar. 13, 2017, which is a continuation of U.S. application Ser. No. 15/014,455, filed Feb. 3, 2016, issued as U.S. Pat. No. 9,592,681 on Mar. 14, 2017, which is a continuation of U.S. application Ser. No. 14/702,942, filed on May 4, 2015, issued as U.S. Pat. No. 9,259,946 on Feb. 16, 2016, which is a continuation of U.S. application Ser. No. 14/190,995, filed Feb. 26, 2014, issued as U.S. Pat. No. 9,022,555 on May 5, 2015, which is a continuation of U.S. application Ser. No. 13/629,718, filed Sep. 28, 2012, issued as U.S. Pat. No. 8,708,481 on Apr. 29, 2014, which claims priority from Japanese Patent Application No. 2011-259605, filed on Nov. 28, 2011, the disclosures of which are incorporated herein by reference in their entirety.

BACKGROUND OF THE INVENTION

Field of the Invention

The present invention relates to ink-jet recording apparatuses recording images on sheet materials, in particular, to an ink-jet recording apparatus capable of recording images on both sides of a sheet material.

Description of the Related Art

Conventionally, in an ink-jet recording apparatus, when images are recorded on a sheet material or a sheet, the sheet and the recording section are set to face each other. Then, it is required to adjust the gap between the sheet and the recording portion with a high accuracy. This is because an increased error in the gap between the sheet and the recording portion will inevitably degrade the quality of the images recorded on the sheet. Such kind of error in the gap between the sheet and the recording portion occurs because, in the main, the sheet warps and floats from a support member supporting the sheet.

Thus, there have been known ink-jet recording apparatuses which hold down the sheet from above at a plurality of places in a width direction to set the sheet into an undulant state so as to diminish the float of the sheet from the support member at the time of recording images on the sheet.

Such an ink-jet recording apparatus includes a platen of which upper surface is formed with alternated ribs and recesses along a sheet width direction, and a sheet material holding plate provided to face the recesses to hold down the sheet. The sheet is supported by the ribs at the positions with the ribs, and held down by the sheet material holding plate at the positions without the ribs. By virtue of this, the sheet is in an undulant state along the width direction, and thereby it is possible to reduce the warpage of sheet as a whole. As a result, this diminishes the float of the sheet from the support member, and thus it is possible to reduce the quality degradation in the images recorded on the sheet.

Further, conventionally, ink-jet recording apparatuses have been known to be capable of recording images on both sides of a sheet. In such an ink-jet recording apparatus, a resupply transport path is formed other than a main transport path transporting the sheet from a tray loading the sheet through a recording section recording images on the sheet to a discharge port. The resupply transport path serves to transport the sheet transported to the downstream side of the recording section with images recorded on its front side by the recording section, back to the upstream side of the recording section in the main transport path. The sheet transported through the resupply transport path arrives at the recording section with its back side facing the recording section. By virtue of this, the recording section is able to record images on the back side of the sheet.

Further, because there is only a limited inner space of the ink-jet recording apparatus to form the transport path and the resupply transport path, the transport path and the resupply transport path are often curved in this inner space. That is, at least parts of the transport path and the resupply transport path are often configured to be curved paths.

SUMMARY OF THE INVENTION

In an ink-jet recording apparatus with the sheet in an undulant state, if the resupply transport path as described above is adopted, then the following problem will arise. That is, it is more difficult to curve an undulant sheet than a flat sheet. Therefore, if the undulant sheet held down by the sheet material holding plate is guided to the resupply transport path, then it is difficult to transport the sheet through the curved path included in the resupply transport path. As a result, the sheet may get jammed in the curved path of the resupply transport path.

The present invention is made in view of the above problems, and an object thereof is to provide an ink-jet recording apparatus capable of reducing quality degradation in images recorded on a sheet by undulating the sheet and, meanwhile, decreasing the possibility of jamming the sheet in the resupply transport path.

According to a first aspect of the present teaching, there is provided an ink-jet recording apparatus including:

a first transporting portion provided in a first transport path, and configured to transport a sheet in a first transporting direction;

a support member provided on the downstream side of the first transporting portion in the first transporting direction, and configured to support the sheet guided through the first transport path;

a recording portion provided to face the support member, and configured to jet ink droplets from nozzles onto the sheet supported on the support member to record an image thereon;

a second transporting portion provided in a second transport path connected with the first transport path at a first connection position on the downstream side of the support member in the first transporting direction, and at a second connection position on the upstream side to the first transporting portion in the first transporting direction, and configured to sandwich and transport the sheet in a second transporting direction from the first connection position toward the second connection position; and a third transporting portion provided on the downstream side of the first connection position in the first transporting direction, and configured to sandwich and transport the sheet in the first transporting direction or toward the second transport path, and a corrugate mechanism provided in the first transport path on the upstream side to the third transporting portion in the first transporting direction, and configured to form a corrugated shape in the sheet;

wherein the second transport path is defined by an upper guide member and a lower guide member; and on the upstream side to the second transporting portion in the second transporting direction, a projecting portion is provided in the upper guide member to project, in side view, toward the side of the lower guide member below a virtual line linking a nip position of the sheet due to the third transporting portion with another nip position of the sheet due to the second transporting portion.

The sheet is held down or pressed by a plurality of contact portions which is included in the corrugate mechanism and is spaced apart in the width direction. Thereby the sheet becomes undulated along the width direction. The undulant sheet is led to the second transport path by the third transport portion and, thereafter, when the front end of the sheet reaches the second transport portion, the sheet comes into such a state as being transported by both the third transport portion and the second transport portion. If the sheet is transported through the second transport path in this state, then it is transported through the second transport path while being pressed or thrust by the projecting portion. At this time, the sheet is laid out by the projecting portion. By virtue of this, the sheet transforms from the undulant state to the even state.

According to a second aspect of the present teaching, there is provided an ink-jet recording apparatus including:

a first transporting portion provided in a first transport path, and configured to transport the sheet in a first transporting direction;

a recording portion provided on the downstream side of the first transporting portion in the first transporting direction, and configured to jet ink droplets from nozzles formed in the recording portion onto the sheet transported in first transporting direction to record an image;

a second transporting portion provided in a second transport path connected with the first transport path at a first connection position on the downstream side of the first transporting portion in the first transporting direction, and at a second connection position on the upstream side to the first transporting portion in the first transporting direction, and configured to sandwich and transport the sheet in a second transporting direction from the first connection position toward the second connection position;

a third transporting portion provided on the downstream side of the first connection position in the first transporting direction, and configured to sandwich and transport the sheet in the first transporting direction or toward the second transport path; and a corrugate mechanism provided in the first transport path, and configured to form a corrugated shape in the sheet;

wherein the second transport path is defined by an upper guide member and a lower guide member; and on the upstream side to the second transporting portion in the second transporting direction, a projecting portion is provided in the upper guide member to project, in side view, toward the side of the lower guide member below a virtual line linking a nip position of the sheet due to the third transporting portion with another nip position of the sheet due to the second transporting portion.

According to a third aspect of the present teaching, there is provided an ink-jet recording apparatus including:

a pair of transporting rollers provided in a first transport path, and configured to transport the sheet in a first transporting direction;

a recording portion provided on the downstream side from the pair of transporting rollers in the first transporting direction, and configured to jet ink droplets from nozzles onto the sheet transported in first transporting direction to record an image;

a pair of reverse rollers provided on the downstream side of the pair of transporting rollers in the first transporting direction, and configured to sandwich and transport the sheet in the first transporting direction, or in a second transporting direction toward a second transport path connected with the first transport path at a first connection position on the downstream side of the pair of transporting rollers in the first transporting direction and on the upstream side to the pair of reverse rollers in the first transporting direction, and at a second connection position on the upstream side to the pair of transporting rollers in the first transporting direction;

a corrugate mechanism provided in the first transport path, and configured to form a corrugated shape in the sheet, wherein the second transport path is defined by an upper guide member and a lower guide member; and wherein in the second transport path, a virtual line along a guide surface of the upper guide member facing the second transport path intersects with a guide surface of the lower guide member facing the second transport path on the upstream side to the second connection position in the second transporting direction.

According to the present teaching, the sheet is held down by the contact portions, and thereby becomes undulated along the width direction. By virtue of this, it is possible to diminish quality degradation of the images recorded on the sheet by the recording portion. Further, the projecting portion lays out the undulant sheet in the course of being transported through the second transport path. By virtue of this, the sheet transforms from the undulant state to the even state. Therefore, in spite of the curved second transport path, it is still possible to reduce the possibility of jamming the sheet in the curved portions of the second transport path.

DESCRIPTION OF THE PREFERRED EMBODIMENT

Figure 1:
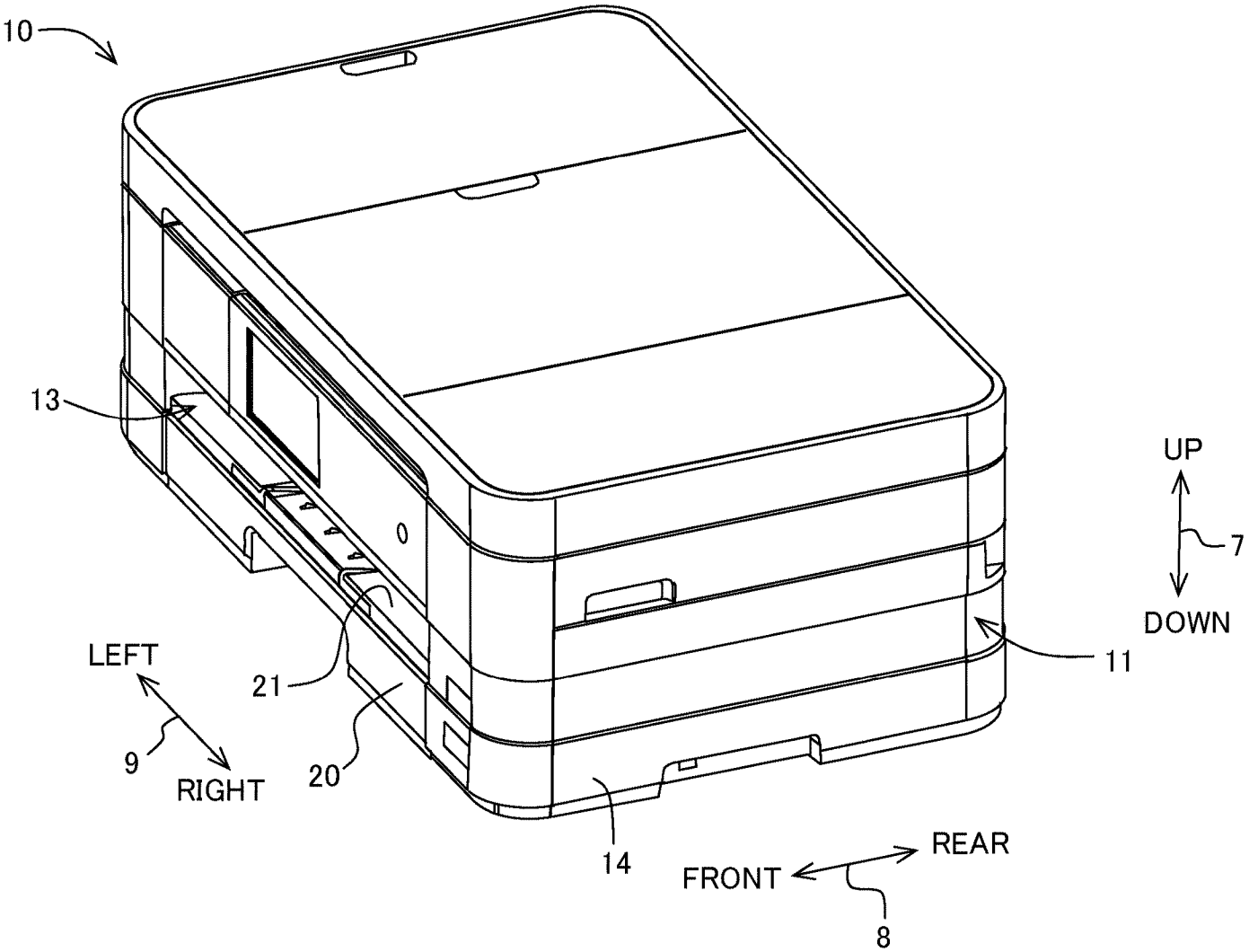
FIG. 1 is a perspective external view of a multifunction printer 10 as an example of the ink-jet recording apparatus in accordance with an embodiment of the present invention.

Hereinbelow, an embodiment of the present invention will be explained. Further, it is needless to say that the embodiment explained below is merely an example of the present invention, and thus it is possible to change the embodiment of the present invention as appropriate without departing from the scope of the present invention. Further, in the following explanations, the term "direction" includes both of the meaning "one-way direction" and "two-way direction". The words "one-way direction" means a direction from starting point to ending point of an arrow, and the words "two-way direction" means the direction from starting point to ending point and the direction from ending point to starting point of the arrow. Further, in the following explanations, an up-down direction 7 is defined based on a reference state (see in FIG. 1) in which a multifunction printer 10, which is an example of the ink-jet recording apparatus of the present teaching, is placed to be operable; a front-rear direction 8 is defined so that a side in which an opening 13 is provided is the front side (front face); and a left-right direction 9 is defined as the multifunction printer 10 is viewed from the front side (front face).

[An Overall Configuration of the Multifunction Printer 10]

Figure 2:
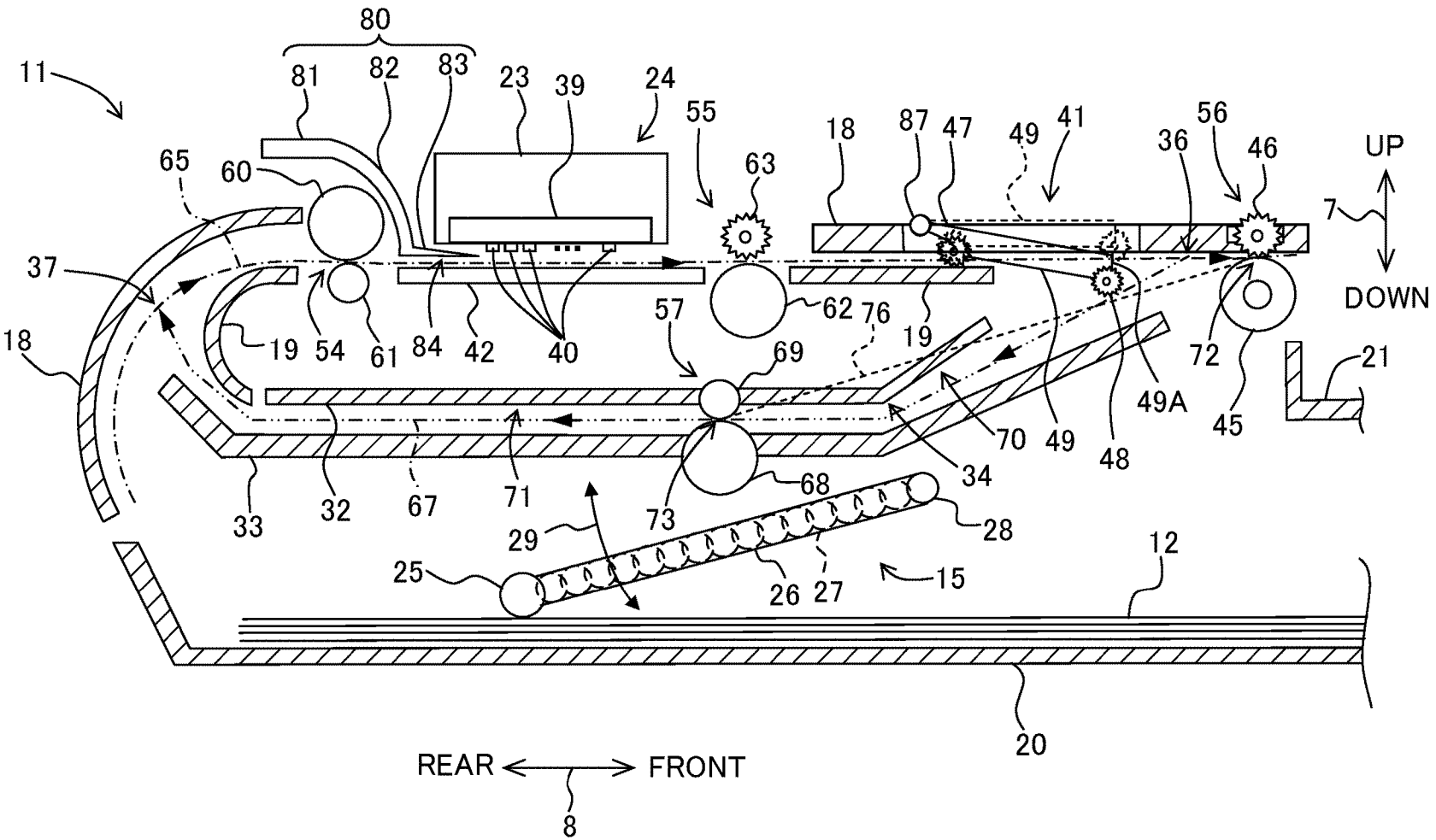
FIG. 2 is a longitudinal sectional view modally showing an inner structure of a printer portion 11.

As shown in FIG. 1, the multifunction printer 10 is formed into an approximate cuboid, and a printer section 11 is provided in a lower portion of the multifunction printer 10 so that the printer section 11 records images on a recording paper 12 (an example of the sheet material of the present invention; see FIG. 2) by an ink-jet recording method. The multifunction printer 10 has various functions such as a facsimile function, a print function, and the like.

The printer section 11 has a case 14 forming the opening 13 in its front side. Further, a paper feeding tray 20 capable of loading the recording paper 12 of various sizes, and a paper discharging tray 21 are insertable to and removable from the opening 13 in the front-rear direction 8.

As shown in FIG. 2, the printer section 11 includes a paper feeding portion 15 to pick up and feed the recording paper 12 from the paper feeding tray 20, a recording portion 24 of an ink-jet recording method provided above the paper feeding tray 20 to record images on the recording paper 12 by jetting ink droplets onto the recording paper 12 fed by the paper feeding portion 15, a pair of transporting rollers 54 transporting the recording paper 12, a pair of discharging rollers 55, a pair of switch back rollers 56, a pair of re-transporting rollers 57, and the like. The pair of transporting rollers 54, the pair of re-transporting rollers 57 and the pair of switch back rollers 56 are examples of the first transporting portion, the second transporting portion and the third transporting portion of the present teaching, respectively.

[The Paper Feeding Portion 15]

As shown in FIG. 2, the paper feeding portion 15 is provided above the paper feeding tray 20 and below the recording portion 24. The paper feeding portion 15 includes a feeding roller 25, a paper feeding arm 26, and a driving force transmission mechanism 27. The feeding roller 25 is pivotally supported at an end portion of the paper feeding arm 26. The paper feeding arm 26 rotates in a direction along an arrow 29 about a shaft 28 provided in its basal end portion. By virtue of this, the feeding roller 25 is able to contact with or separate from the paper feeding tray 20. That is, the feeding roller 25 is configured to be able to contact with the recording paper 12 loaded in the paper feeding tray 20.

A paper feeding motor (not shown) transmits a driving force to the feeding roller 25 to rotate the same. The feeding roller 25 sends out a sheet of the recording paper 12 to a transport path 65 explained below by separating it from other recording paper 12 in a state of contact with the uppermost recording paper 12 among the plurality sheets of the recording paper 12 placed on the paper feeding tray 20.

[The Transport Path 65]

As shown in FIG. 2, the transport path 65, which is an example of the first transport path of the present teaching, is curved upward from the rear end of the paper feeding tray 20 to the front side of the multifunction printer 10, and extends out from the rear side (backside) to the front side (foreside) of the multifunction printer 10. The transport path 65 leads to the paper discharge tray 21 through the sandwich position due to the pair of transporting rollers 54, the lower side of the recording portion 24, the sandwich position due to the pair of discharging rollers 55, and the sandwich position due to the pair of switch back rollers 56. The transport path 65 causes the recording paper 12 fed from the paper feeding tray 20 to U-turn from the lower side to the upper side to be guided to the recording portion 24. The recording paper 12 is guided to the paper discharging tray 21 after the image recording by the recording portion 24. The direction of transporting the recording paper 12 is referred to as a first transporting direction. The first transporting direction is shown in FIG. 2 by the arrow of a chain line. Further, the first transporting direction is an example of the first transporting direction of the present teaching. Except for the portions of the transport path 65 provided with the recording portion 24, the roller pairs 54, 55 and 56, etc., the transport path 65 is formed by an outer guide member 18 and an inner guide member 19 facing each other at a predetermined gap.

There is a branch position 36 which is an example of the first position of the present teaching on the downstream side from the recording portion 24 and an after mentioned platen 42 in the first transporting direction. In the case of both-sided image recording, the recording paper 12 transported through the transport path 65 is switched back on the downstream side of the branch position 36, and transported toward an after mentioned reverse transport path 67.

[The Pair of Transporting Rollers 54, Pair of Discharging Rollers 55 and Pair of Switch Back Rollers 56]

As shown in FIG. 2, on the upstream side to the recording portion 24 in the first transporting direction in the transport path 65, the pair of transporting rollers 54 is provided to have a transporting roller 60 and a pinch roller 61. In the transport path 65, on the downstream side from the recording portion 24 and the upstream side to the branch position 36 in the first transporting direction, the pair of discharging rollers 55 is provided to have a discharging roller 62 and a spur 63. On the downstream side from the branch position 36 in the first transporting direction in the transport path 65, the pair of switch back rollers 56 is provided to have a switch back transporting roller 45 and a spur 46.

The transporting roller 60 and pinch roller 61 constituting the pair of transporting rollers 54, the discharging roller 62 and spur 63 constituting the pair of discharging rollers 55, as well as the switch back transporting roller 45 and spur 46 constituting the pair of switch back rollers 56, are mutually contacted in pair to sandwich and transport the recording paper 12, respectively.

A driving force of positive rotation direction or negative rotation direction is transmitted from a transporting motor (not shown) to the transporting roller 60 and the discharging roller 62 to rotate the both positively or negatively. For example, if the driving force of positive rotation direction is transmitted from the transporting motor, then the transporting roller 60 and the discharging roller 62 rotate positively to transport the recording paper 12 in the first transporting direction. If the driving force of negative rotation direction is transmitted from the transporting motor, then the transporting roller 60 and the discharging roller 62 rotate negatively to transport the recording paper 12 in the opposite orientation to first transporting direction.

In the same manner as the transporting roller 60 and the discharging roller 62, the driving force of positive or negative rotation direction is transmitted from the transporting motor to the switch back transporting roller 45 to rotate the same positively or negatively. In detail, if a single-sided recording is carried out, then the switch back transporting roller 45 is rotated positively. By virtue of this, the recording paper 12 is sandwiched by the switch back transporting roller 45 and the spur 46, transported in the first transporting direction, and discharged to the paper discharging tray 21. On the other hand, if a both-sided recording is carried out, then the rotation direction of the switch back transporting roller 45 is shifted from positive rotation to negative rotation with the switch back transporting roller 45 and the spur 46 sandwiching the rear end portion of the recording paper 12. By virtue of this, the recording paper 12 is transported in the opposite orientation to the first transporting direction toward the reverse transport path 67 while being guided by path switch portions 41.

[The Platen 42]

As shown in FIG. 2, the platen 42, which is an example of the support member of the present teaching, is provided below the transport path 65 between the pair of transporting rollers 54 and the pair of discharging rollers 55. That is, the platen 42 is provided on the downstream side from the pair of transporting rollers 54 in the first transporting direction. The platen 42 is an approximately thin plate-like member.

Figure 3:
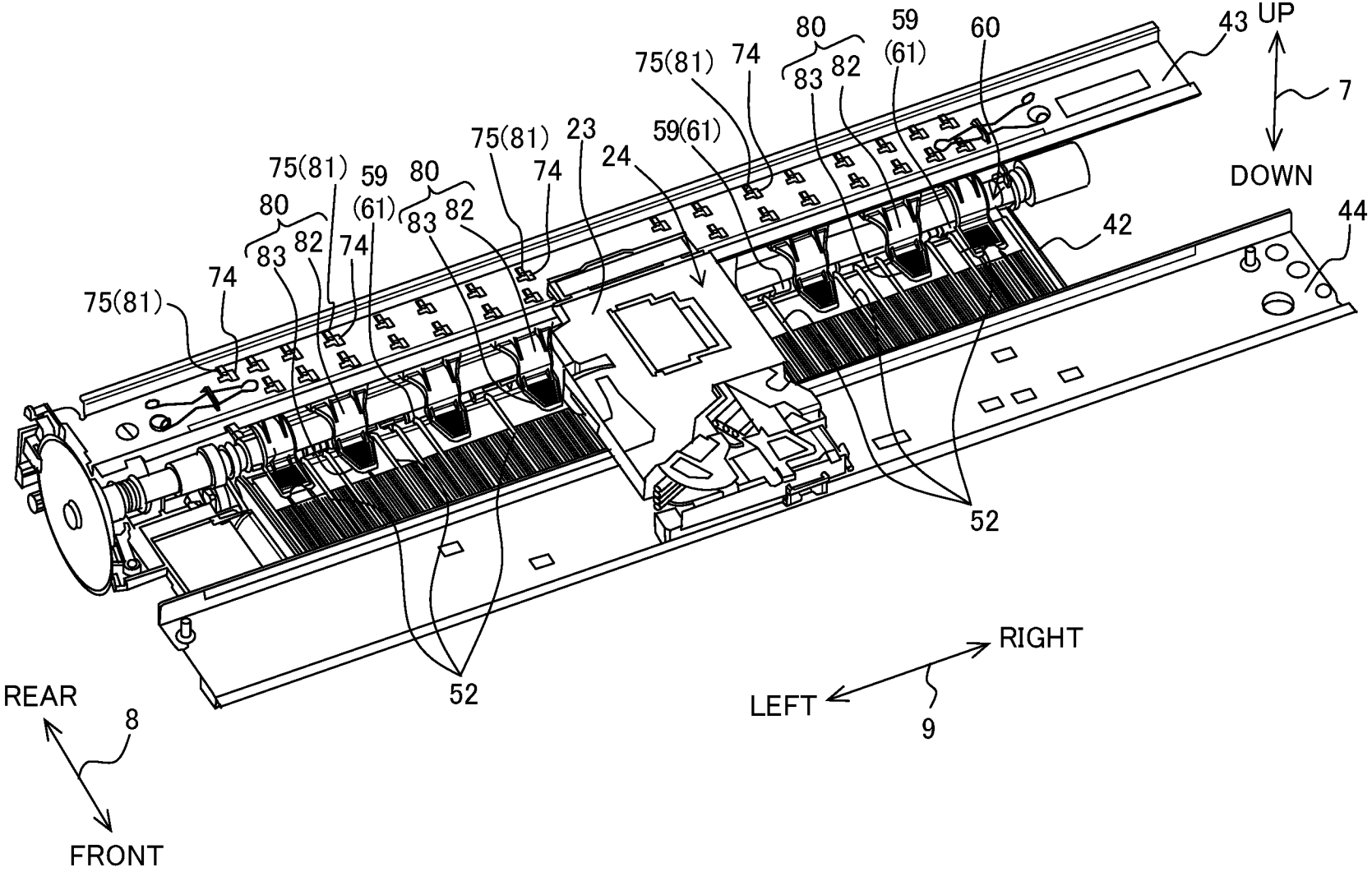
FIG. 3 is a perspective view showing a recording portion 24, platen 42, and guide rails 43 and 44.
Figure 4:
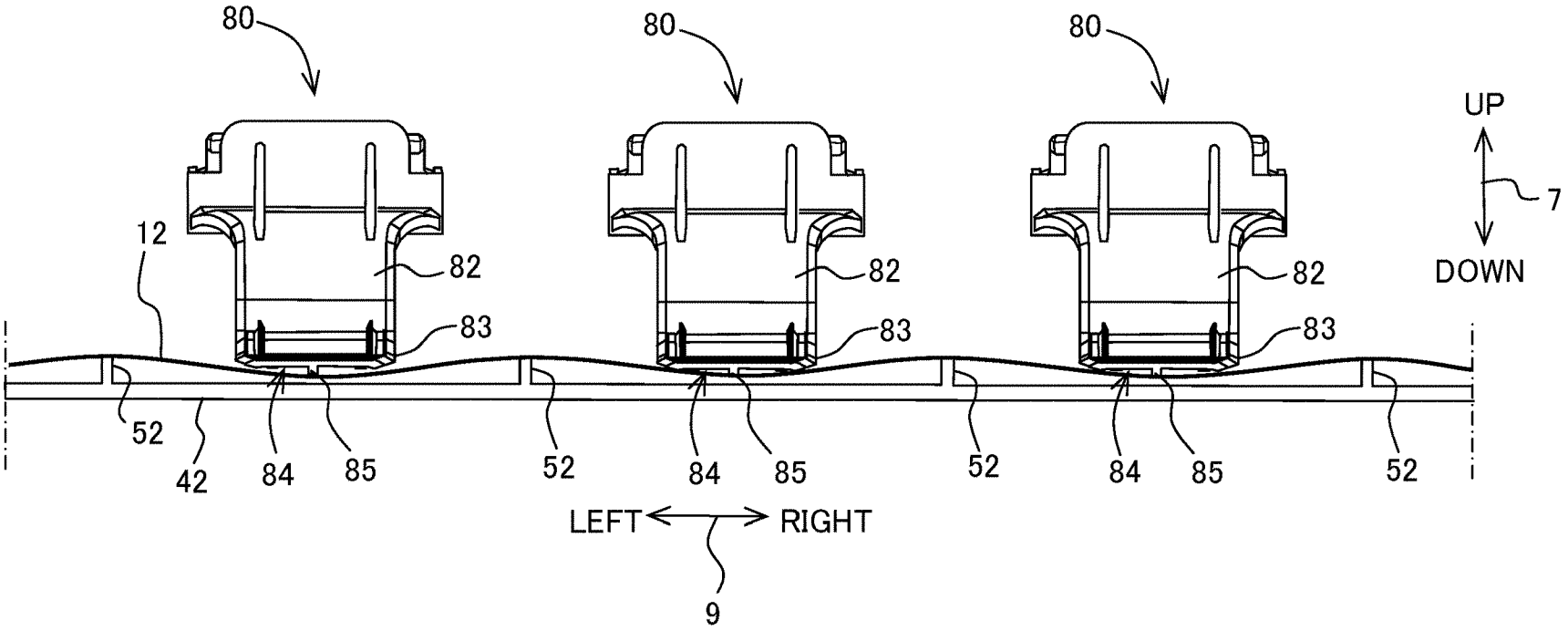
FIG. 4 is a front view showing the platen 42, contact members 80, and a recording paper 12.

As shown in FIG. 3, on the upper surface of the platen 42, a plurality of support ribs 52 are formed to project upward. Each of the support ribs 52 extends in the front-rear direction 8. In detail, the support ribs 52 each extend in the front-rear direction 8 at least in the positions facing nozzles 40 which will be described hereinafter. In this embodiment, the support ribs 52 each extend up to the rear side farther than the position facing the nozzles 40. In other words, as shown in FIGS. 2 and 4, the support ribs 52 each extend in the front-rear direction 8 up to the position of providing after mentioned contact portions 83 of contact members 80.

Further, the support ribs 52 are formed at a predetermined gap between each other in the left-right direction 9. The recording paper 12 transported through the transport path 65 is supported by the platen 42. In detail, the recording paper 12 is supported by each of the support ribs 52 formed on the upper surface of the platen 42. That is, the platen 42 supports the recording paper 12 guided through the transport path 65 from below.

[The Recording Portion 24]

As shown in FIG. 2, the recording portion 24 is provided above the transport path 65 to face the platen 42. The recording portion 24 includes a carriage 23 and a recording head 39. As shown in FIG. 3, the carriage 23 is supported by guide rails 43 and 44 provided respectively on the rear side and front side of the platen 42. A belt mechanism is provided for at least one of the guide rails 43 and 44, and the carriage 23 is connected to the belt mechanism. A carriage motor drives the belt mechanism, and thereby the carriage 23 is movable in the left-right direction 9. Further, the belt mechanism and the carriage motor are both known, and their illustrations are omitted.

As shown in FIG. 2, the recording head 39 is placed on the carriage 23. The plurality of nozzles 40 are formed on the lower surface of the recording head 39. The recording head 39 is supplied with ink from an ink cartridge (not shown). The recording head 39 jets the ink in the form of tiny ink droplets from the nozzles 40. When the carriage 23 is reciprocating in the left-right direction 9, the ink droplets are jetted from the nozzles 40 onto the recording paper 12 supported on the platen 42. By virtue of this, images are recorded on the recording paper 12.

[The Contact Members 80]

Figure 5:
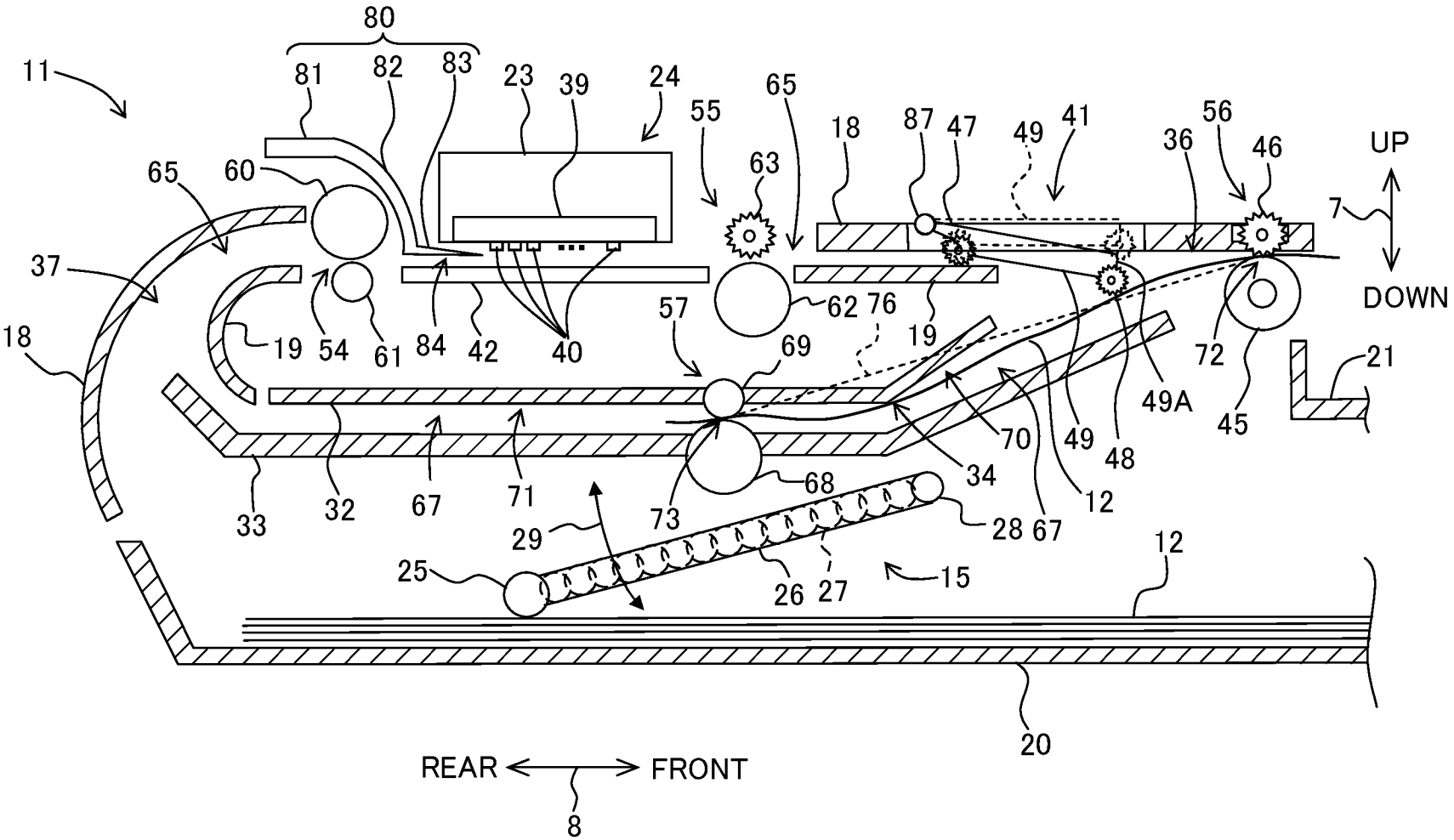
FIG. 5 is another longitudinal sectional view modally showing the inner structure of the printer portion 11, and showing a state of the recording paper 12 in contact with a projecting portion 34.
Figure 6:
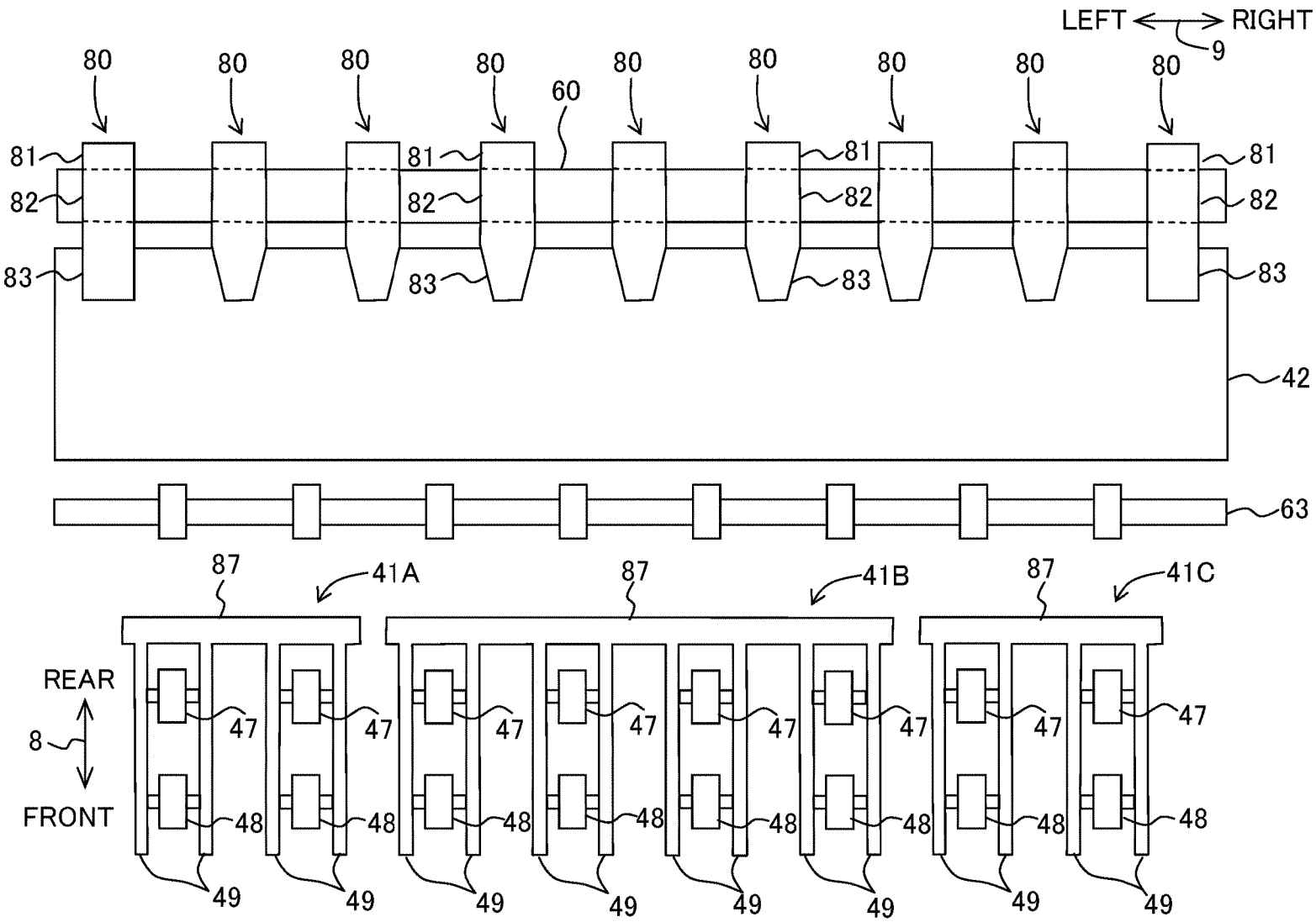
FIG. 6 is a plan view modally showing the contact members 80, a transporting roller 60, the platen 42, a spur 63, and a path switch portions 41.

As shown in FIG. 2, the plurality of contact members 80 are provided in the transport path 65 on the upstream side to the nozzles 40 in the first transporting direction. In this embodiment, as shown in FIG. 6, nine contact members 80 are provided. Note that the number of the contact members 80 may as well be less than nine or more than nine. As shown in FIGS. 2, 3 and 5, each of the contact members 80 includes a fitting portion 81, a curved portion 82, and a contact portion 83.

The fitting portions 81 are shaped into approximately flat plates. Each fitting portion 81 is fitted on the guide rail 43 as will be explained in detail. As shown in FIG. 3, from the upper surface of each fitting portion 81, a plurality of catching portions 75 project upward. Further, although four catching portions 75 are provided in this embodiment, the number of the catching portions 75 may as well be less than four or more than four. The catching portions 75 are flexed rearward in the upper end portions. On the other hand, a plurality of openings 74 is provided in the guide rail 43. The catching portions 75 are each inserted through the openings 74 and caught in the openings 74. By virtue of this, the upper surface of each fitting portion 81 is fixed on the lower surface of the guide rail 43. Further, the fitting portions 81 are fixed apart from each other in the left-right direction 9, respectively.

As shown in FIGS. 2 and 3, the curved portions 82 are provided to project frontward from the fitting portions 81. The curved portions 82 are curved downward while extending frontward. From the apical ends i.e. front ends of the curved portions 82, the contact portions 83 project frontward. As described above, in the same manner as the fitting portions 81, the curved portions 82 and the contact portions 83 are also arranged apart from each other in the left-right direction 9, respectively.

As shown in FIGS. 2 and 3, the contact portions 83 are shaped into approximately flat plates. The contact portions 83 are provided at the positions facing the platen 42, on the upstream side to the nozzles 40 of the recording portion 24 in the first transporting direction. In detail, the contact portions 83 are provided at the positions facing the platen 42, on the upstream side to the rearmost nozzles 40 among the plurality of nozzles 40 in the first transporting direction. FIG. 4 shows lower surfaces 84 of the contact portions 83. Contact ribs 85 are provided to project downward from the lower surfaces 84 of the contact portions 83, respectively. The lower ends of the contact ribs 85 are positioned below the lower surface of the recording head 39, and contact with the upper surface of the recording paper 12, that is, the image recording surface of the recording paper 12 supported on the platen 42. By virtue of this, the recording paper 12 is held down by the contact portions 83 toward the lower side, i.e., toward the platen 42.

Further, the contact portions 83 may as well not be provided with the contact ribs 85. In this case, the lower surfaces 84 of the contact portions 83 contact with the upper surface of the recording paper 12. That is, the lower surfaces 84 of the contact portions 83 become the lower ends of the contact portions 83.

Here, as shown in FIG. 4, each support rib 52 formed on the platen 42 is positioned in the left-right direction 9 where each contact portion 83 is not formed. That is, the contact portions 83 and the support ribs 52 do not face each other. Further, each support rib 52 projects upward above the lower end of the contact rib 85 of each contact portion 83. In the above manner, the recording paper 12 transported through the transport path 65 becomes undulant between the platen 42 and the contact portions 83, as viewed from the front side or the rear side.

[The Path Switch Portions 41]

As shown in FIG. 2, the path switch portions 41 are arranged in the branch position 36.

One or a plurality of path switch portions 41 is/are provided in the transport path 65 along the left-right direction 9. In this embodiment, as shown in FIG. 6, three path switch portions 41A to 41C are arranged in the transport path 65 to be apart from each other in the left-right direction 9. Of course, the number of the path switch portions 41 is not necessarily three, but may as well be less than three or more than three.

The path switch portions 41A to 41C each include auxiliary rollers 47 and auxiliary rollers 48 which are an example of the spur of the present teaching, flaps 49, and a support shaft 87. In detail, the path switch portions 41A and 41C positioned at both ends of the transport path 65 in the left-right direction 9 are each constructed by a support shaft 87, four flaps 49, two auxiliary rollers 47, and two auxiliary rollers 48. Further, the path switch portion 41B positioned at the center of the transport path 65 in the left-right direction 9 includes a support shaft 87, eight flaps 49, four auxiliary rollers 47, and four auxiliary rollers 48. Because each path switch portion 41 has the support shaft 87 individually, it is rotatable individually.

Each support shaft 87 extends in the left-right direction 9, and is rotatably fixed on the frame and the like of the printer section 11. In this embodiment, each support shaft 87 is rotatably fixed on the outer guide member 18.

Each flap 49 extends out from the support shaft 87 to the downstream side in the first transporting direction. By virtue of this, each flap 49 rotates along with the rotation of the support shaft 87. Further, the flaps 49 are each arranged at a predetermined gap in the left-right direction 9.

Each auxiliary roller 47 is sandwiched by two flaps 49 in the left-right direction 9, and pivotally supported to be rotatable by these two flaps 49. In the same manner as the auxiliary roller 47, each auxiliary roller 48 is also sandwiched by two flaps 49, and pivotally supported to be rotatable by these two flaps 49. Each auxiliary roller 47 is fixed on the basal end side of the flaps 49, i.e. the support shaft 87 side, while each auxiliary roller 48 is fixed on the apical end side of the flaps 49.

Further, the positions of each auxiliary roller 47 and each auxiliary roller 48 in the transport path 65 along the left-right direction 9 are different from the position of the contact portion 83 of each contact member 80 in the transport path 65 along the left-right direction 9. That is, each auxiliary roller 47 and each auxiliary roller 48 are provided in different positions from the position of each contact portion 83 in the left-right direction 9.

The flaps 49 are configured to be changeable in posture, and revolve or rotate between a discharge posture positioned above the inner guide member 19, and a reverse posture in which extended ends 49A enter below the branch position 36. Here, the discharge posture is an example of the first posture of the present teaching, and is shown in FIG. 2 by broken line. Further, the reverse posture is an example of the second posture of the present teaching, and is shown in FIG. 2 by solid line. That is, the apical end portion of each flap 49 in the reverse posture is positioned below the apical end portion of each flap 49 in the discharge posture. In other words, the reverse posture is a posture positioned below the discharge posture.

Although each flap 49 generally maintains its reverse posture due to its own weight, when raised by the recording paper 12 transported there from right below the recording portion 24, it changes the reverse posture to the discharge posture. If the flaps 49 are in the discharge posture, then the recording paper 12 is further transported to the downstream side in the first transporting direction. Then, the auxiliary rollers 47 and 48 rotate because of contacting with the upper surface of the recording paper 12 transported there. That is, the path switch portions 41 in the discharge posture guide the upper surface of the recording paper 12 transported through the transport path 65 in the first transporting direction to lead the recording paper 12 along the transport path 65.

Thereafter, if the rear end of the recording paper 12 has passed through the place right below the auxiliary rollers 47, then the downward force of each flap 49 due to its own weight becomes larger than the force of the recording paper 12 pressing the flaps 49 upward. By virtue of this, each flap 49 returns from the discharge posture back to the reverse posture due to its own weight. As a result, the rear end of the recording paper 12 turns to a direction of the reverse transport path 67. In this state, if the switch back transporting roller 45 is rotated positively, then the recording paper 12 is discharged to the paper discharging tray 21.

On the other hand, with the rear end of the recording paper 12 facing the direction of the reverse transport path 67, if the switch back transporting roller 45 is rotated negatively, then the recording paper 12 is transported to the reverse transport path 67. That is, if the flaps 49 are in the reverse posture, then the recording paper 12 is switched back and transported to the reverse transport path 67. At this time, the auxiliary rollers 48 rotate because of contacting with the upper surface of the recording paper 12 transported through the transport path 65 in a second transporting direction. Then, the recording paper 12 is led to the reverse transport path 67 via the auxiliary rollers 48 of the path switch portions 41. That is, the path switch portions 41 in the reverse posture contact with the upper surface of the recording paper 12 transported through the transport path 65, to lead the recording paper 12 to the reverse transport path 67.

[The Reverse Transport Path 67]

As shown in FIG. 2, the reverse transport path 67 corresponding to the second transport path of the present teaching is branched at the branch position 36 from the transport path 65, passes through the place below the platen 42 and above the paper feeding arm 26, and extends to join the transport path 65 at a junction position 37 on the upstream side to the pair of transporting rollers 54 in the first transporting direction. That is, the reverse transport path 67 is connected with the transport path 65 at the branch position 36 and the junction position 37. Further, the junction position 37 is an example of the second position of the present teaching.

The recording paper 12 is guided through the reverse transport path 67 in the second transporting direction. Here, the second transporting direction is the orientation of directing the reverse transport path 67 from the branch position 36 to the junction position 37, and is shown in FIG. 2 by the two-dot chain line with arrows.

An upper guide member 32 partitions the space above the reverse transport path 67. Further, a lower guide member 33 partitions the space below the reverse transport path 67. The upper guide member 32 and the lower guide member 33 are arranged to face each other at a predetermined gap through which the recording paper 12 is passable. Further, the upper guide member 32 and the lower guide member 33 extend in the left-right direction 9, i.e. the direction perpendicular to the paper plane of FIG. 2. Further, an after mentioned projecting portion 34 is formed with the upper guide member 32.

[The Pair of Re-transporting Rollers 57]

In the reverse transport path 67, the pair of re-transporting rollers 57 is provided to have a re-transporting roller 68 and a pinch roller 69. The re-transporting roller 68 and the pinch roller 69 contact with each other to sandwich and transport the recording paper 12. A rotation driving force is transmitted to the re-transporting roller 68 from the transporting motor (not shown) via a driving force transmission mechanism (not shown) so as to rotate the same. The driving force transmission mechanism includes a planet gear and the like. The driving force transmission mechanism causes the re-transporting roller 68 to rotate in one rotational direction so as to transport the recording paper 12 in the second transporting direction whether the transporting motor rotates in the positive rotation direction or in the negative rotation direction.

[The Projecting Portion 34]

As shown in FIG. 2, in this embodiment, the upper guide member 32 of the reverse transport path 67 is arranged to flex on the upstream side to the pair of re-transporting rollers 57 in the second transporting direction. In particular, the surface of the upper guide member 32 on the side of the reverse transport path 67 includes a first surface 70 and a second surface 71.

The first surface 70 inclines so that it becomes low in height to a certain extent on the rear side. That is, the first surface 70 is a surface inclined at a predetermined angle from the horizontal surface extending parallel to the front-rear direction 8 and the left-right direction 9. The second surface 71 is an approximately horizontal surface extending approximately parallel to the front-rear direction 8 and the left-right direction 9. That is, the first surface 70 has a larger inclination angle than the second surface 71 with respect to the horizontal plane. Further, the second surface 71 may as well be an inclined surface with a smaller inclination angle than the first surface 70. Because the first surface 70 is an inclined surface while the second surface 71 is an approximately horizontal surface, the projecting portion 34 is formed at the boundary between the first surface 70 and second surface 71. Further, as described above, because the first surface 70 and the second surface 71 are surfaces extending in the left-right direction 9, the projecting portion 34 at which the first surface 70 intersects the second surface 71 defines a line extending in the left-right direction 9 which is an example of the width direction of the present teaching.

A broken line 76 in FIG. 2 is an example of the virtual line of the present teaching, and it is a virtual line linking the sandwich position 72 of the recording paper 12 due to the pair of switch back rollers 56 with the sandwich position 73 of the recording paper 12 due to the pair of re-transporting rollers 57. Here, the projecting portion 34 projects to the side of the lower guide member 33 below the broken line 76. That is, in side view, based on the broken line 76, the projecting portion 34 constitutes a projection projecting to the side of the lower guide member 33.

When the fore-end portion of the recording paper 12 transported through the reverse transport path 67 is sandwiched by the pair of re-transporting rollers 57, as shown in FIG. 5, not only the fore-end portion of the recording paper 12 is sandwiched by the pair of re-transporting rollers 57 but also the rear-end portion is sandwiched by the pair of switch back rollers 56.

Here, in the multifunction printer 10, the speed of transporting the recording paper 12 due to the re-transporting roller 68 is generally set to be higher than the speed of transporting the recording paper 12 due to the switch back transporting roller 45. This is for preventing the recording paper 12 transported through the reverse transport path 67 from warpage between the pair of switch back rollers 56 and the pair of re-transporting rollers 57. Further, the speed of transporting the recording paper 12 due to each transporting roller is set with a different gear ratio, for example, for the gears arranged to transmit driving forces between the transporting motor and each of the transporting rollers 45 and 68.

When each transport speed of the transporting rollers 45 and 68 is set in the above manner, if the recording paper 12 is transported in the second transporting direction with its front and rear ends sandwiched respectively by the roller pairs 56 and 57, then the recording paper 12 is in a stretched state between the pair of switch back rollers 56 and the pair of re-transporting rollers 57. At this time, the upper surface of the recording paper 12 contacts with the upper guide member 32 on the projecting portion 34.

In this state, if the recording paper 12 is further transported in the second transporting direction, then the upper surface of the recording paper 12 is laid out at the projecting portion 34. By virtue of this, in the recording paper 12 being undulated by the contact portions 83 of the contact members 80 and the support ribs 52 of the platen 42, the undulant amplitude is reduced. In other words, even if the recording paper 12 is deformed into an undulant shape by the contact portions 83 and the support ribs 52, it is laid out by the projecting portion 34 to reduce the deformation and become sufficiently even.

Effects of the Embodiment

According to this embodiment, the recording paper 12 is held down by the plurality of contact portions 83 of the contact members 80 spaced apart in the left-right direction 9, and thereby undulated along the left-right direction 9. This undulant recording paper 12 is led by the pair of switch back rollers 56 to the reverse transport path 67 and, then, as the front end of the recording paper 12 reaches the pair of re-transporting rollers 57, the recording paper 12 is sandwiched by both of the pair of switch back rollers 56 and the pair of re-transporting rollers 57. In this state, if the recording paper 12 is transported through the reverse transport path 67, then it is transported through the reverse transport path 67 while being pressed on the projecting portion 34. At this time, the recording paper 12 is separated one by one by the projecting portion 34. By virtue of this, the recording paper 12 transforms from the undulant state to the even state. In the above manner, according to this embodiment, it is possible to reduce the possibility of jamming the recording paper 12 in the reverse transport path 67.

Further, according to this embodiment, in the left-right direction 9, the undulant recording paper 12 forms troughs at the positions held down by the contact portions 83 of the contact members 80, and crests at the positions supported by the support ribs 52. Here, in this embodiment, the auxiliary rollers 48 are provided at different positions from those of the contact portions 83 in the left-right direction 9. Therefore, in this embodiment, the auxiliary rollers 48 hold down the crest portions of the recording paper 12 transported through the reverse transport path 67. By virtue of this, it becomes easy for the recording paper 12 to transform from the undulant state to the even state.

Further, if only one path switch portion 41 is provided while a plurality of auxiliary rollers 48 are arranged in the path switch portion 41 along the left-right direction 9, then in case the recording paper 12 is warped as a whole in the left-right direction 9, the following problem will arise. That is, although the auxiliary rollers 48 facing the floating portions of the warped recording paper 12 as a whole can hold down the crest portions of the recording paper 12, those not facing the floating portions of the warped recording paper 12 as a whole cannot reach the recording paper 12. That is, the auxiliary rollers 48 cannot hold down the crest portions of the recording paper 12. In this embodiment however, because a plurality of path switch portions 41 are provided along the left-right direction 9, each path switch portion 41 can change its posture individually. By virtue of this, independent of the warpage of the recording paper 12, all auxiliary rollers 48 can hold down the crests of the recording paper 12. As a result, it is easy for the recording paper 12 to transform from the undulant state to the even state.

First Modification

In the above embodiment, the printer portion 11 is provided with a plurality of contact members 80, each of which includes the fitting portion 81, curved portion 82, and contact portion 83. However, the contact members 80 may as well be configured as a single-body member. In this case, the contact member 80 is, for example, configured by one fitting portion 81 extending along the left-right direction 9, a plurality of curved portions 82 (see FIGS. 3 and 5), and a plurality of contact portions 83 (see FIGS. 3 and 5).

In the above embodiment, although the plurality of fitting portions 81 are fixed apart from each other on the guide rail 43 in the left-right direction 9, in the first modification however, the single-body fitting portion 81 is fixed on the guide rail 43. Then, the plurality of curved portions 82 are provided to project frontward from the single-body fitting portion 81. At this stage, the plurality of curved portions 82 are provided to project from the positions spaced apart from each other in the left-right direction 9. Further, it is the same as in the above embodiment that the contact portions 83 project frontward from the apical end portions of the curved portions 82.

Second Modification

In the above embodiment, the upper guide member 32 includes the first surface 70 and the second surface 71 each of which is a single flat surface. Then, the first surface 70 and the second surface 71 guide the recording paper 12 in the reverse transport path 67. However, the upper guide member 32 may as well not have single flat surfaces such as the first surface 70 and the second surface 71. For example, as shown in FIG. 7, the upper guide member 32 may as well be formed of a plurality of ribs 32A to 32E formed at predetermined gaps in the left-right direction 9 to extend approximately along the front-rear direction 8, i.e., along the second transporting direction.

Figure 7:
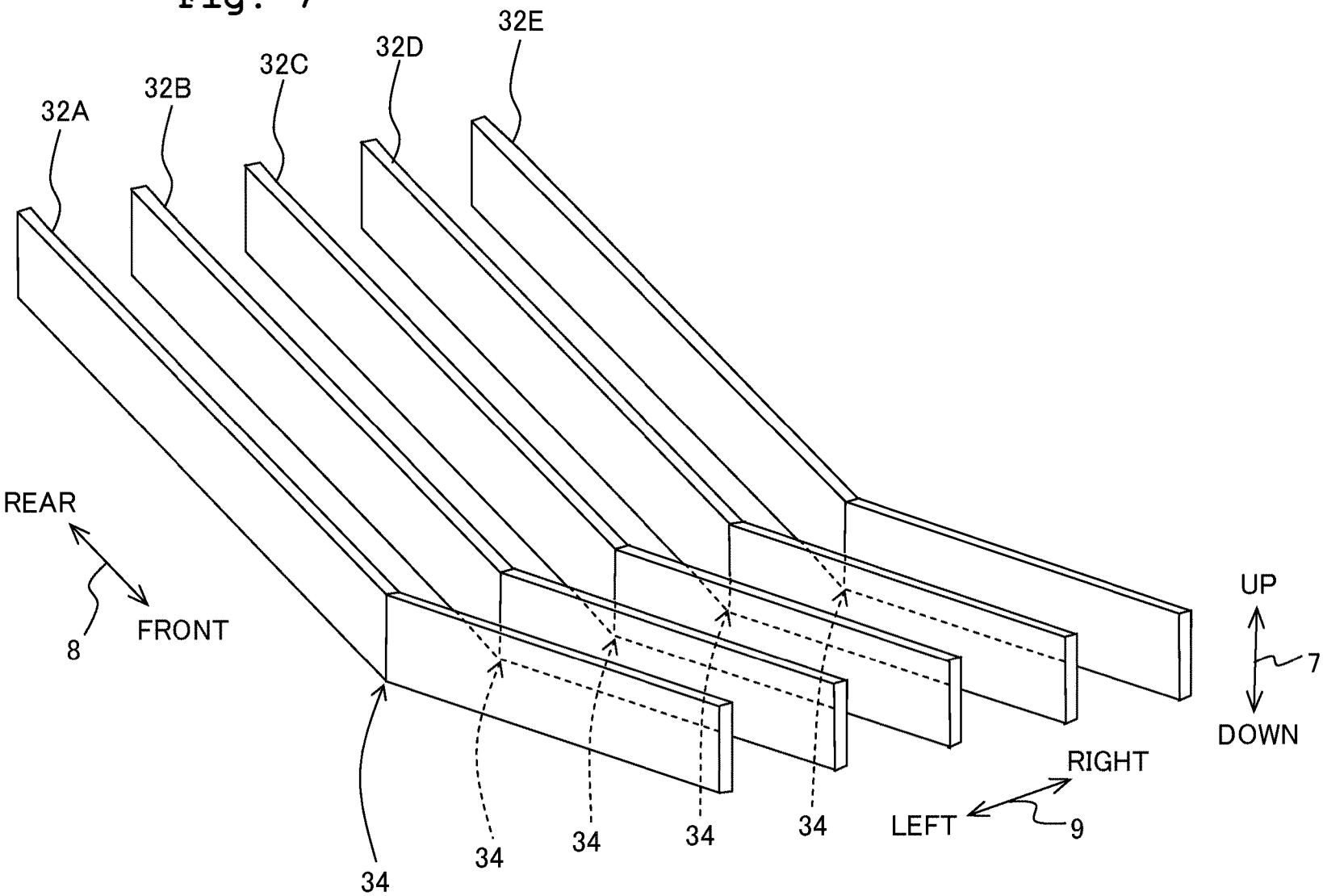
FIG. 7 is a perspective view modally showing an upper guide member 32 in accordance with a second modification.

Further, FIG. 7 is a perspective view modally showing only the upper guide member 32 configured by the ribs 32A to 32E. Further, although the upper guide member 32 is configured by five ribs in FIG. 7, the number of ribs is not limited to five.

In the second modification as shown in FIG. 7, the projecting portions 34 are formed to have the same number as the ribs. That is, the projecting portion 34 defines a line extending in the left-right direction 9 in the above embodiment, whereas a plurality of projecting portions 34 are provided at gaps along the left-right direction 9 in the second modification.

Figure 9:
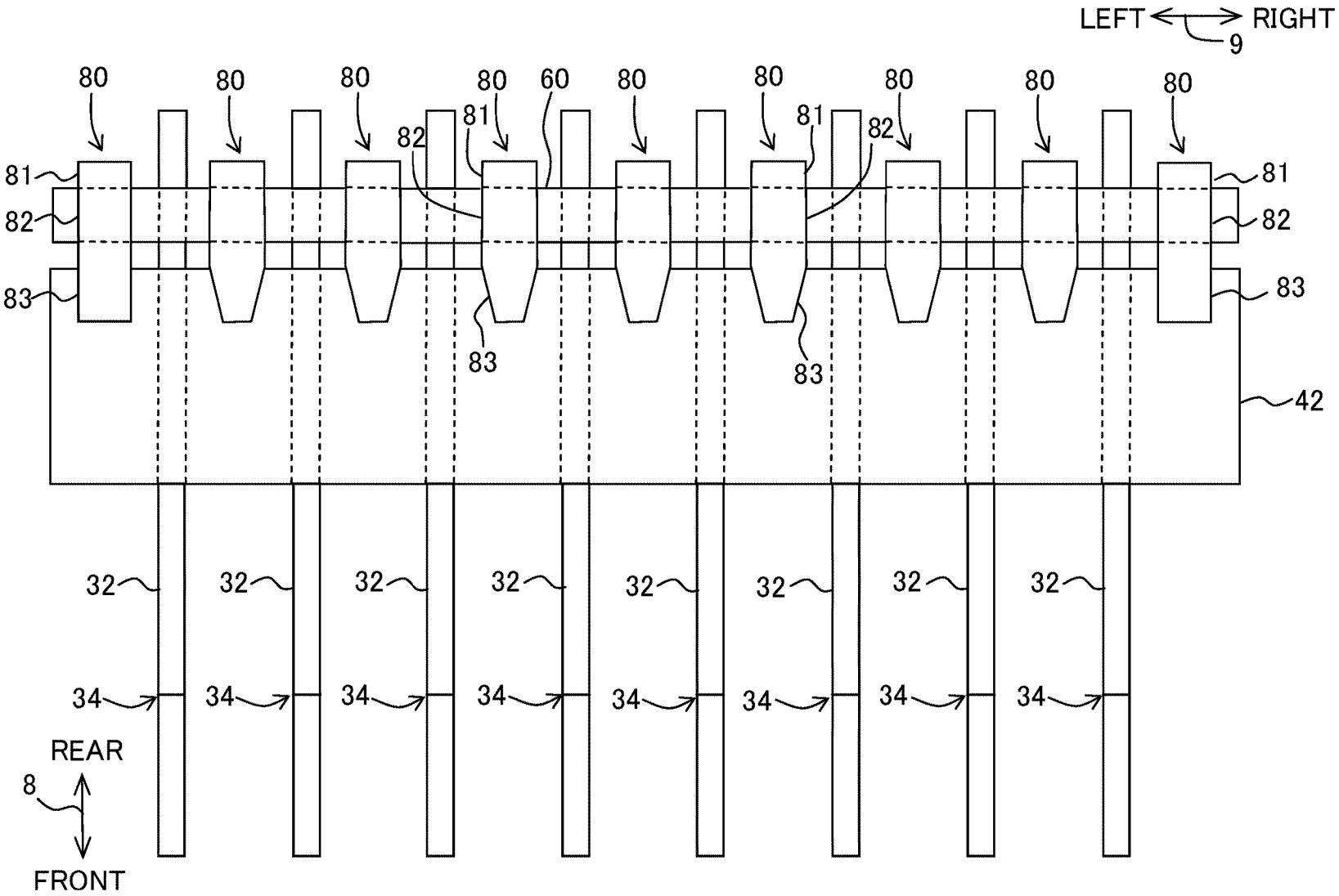
FIG. 9 is a plan view modally showing the contact members 80, the transporting roller 60, the platen 42, and the upper guide member 32.

Further, if a plurality of projecting portions 34 are provided at gaps along the left-right direction 9 as in the second modification, then as shown in FIG. 9, the position of each projecting portion 34 in the left-right direction 9 may as well be different from that of the contact portion 83 of each contact member 80 in the left-right direction 9. That is, the projecting portions 34 may as well be provided at different positions from those of the contact portions 83 in the left-right direction 9.

Third Modification

In the above embodiment, the upper guide member 32 is formed of the first surface 70 and the second surface 71, and the projecting portion 34 is formed by the first surface 70 and the second surface 71. However, the projecting portion of the present teaching is not limited to the projecting portion 34 in the above embodiment.

Figure 8:
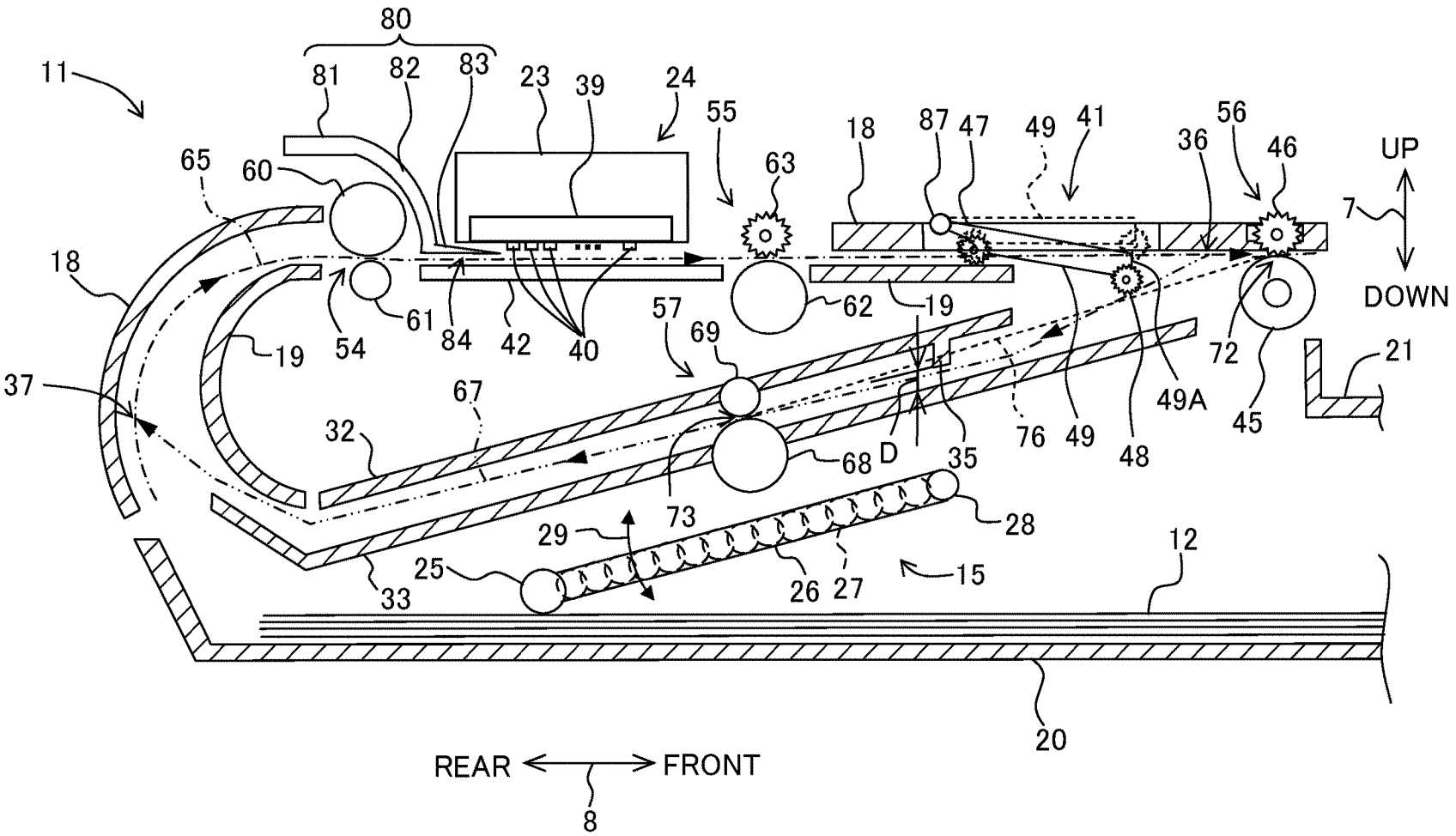
FIG. 8 is a longitudinal sectional view modally showing an inner structure of a printer portion 11 in accordance with a third modification.

For example, a projecting portion 35 as shown in FIG. 8 may be formed to project downward (toward the side of the lower guide member 33) on the lower surface of the upper guide member 32.

Further, either one projecting portion 35 may be provided to extend in the left-right direction 9, or a plurality of projecting portions 35 may be provided at gaps along the left-right direction 9.

Fourth Modification

The distance between the upper guide member 32 and the lower guide member 33 in the reverse transport path 67 may reach the minimum at the place between the projecting portion and the lower guide member of the present invention. For example, the configuration shown in FIG. 8 corresponds to the above configuration. That is, in the configuration shown in FIG. 8, the distance D between the projecting portion 35 and the lower guide member 33 reaches the minimum in the reverse transport path 67.

Fifth Modification

In the above embodiment, although each path switch portion 41 includes both sets of the auxiliary rollers 47 and 48, it may include either only one set of the auxiliary rollers 47 and 48 or none of the auxiliary rollers 47 and 48.

For example, if the path switch portions 41 do not include the auxiliary rollers 47 and 48, then the upper surface of the recording paper 12 transported through the transport path 65 contacts with the flaps 49. In this case, the position of each flap 49 in the left-right direction 9 may be different from that of the contact portion 83 of each contact member 80 in the left-right direction 9. That is, each path switch portion 41 may contact with the recording paper 12 in a different position from that in which each contact portion 83 contacts with the recording paper 12, to guide the upper surface of the recording paper 12.

Except for unperformable cases, it is also possible to appropriately combine the abovementioned embodiment and one or more modifications as necessary.

What is claimed is:

1. An ink-jet recording apparatus comprising:

a housing defining a first transport path through which a sheet is transported in a first transporting direction and a second transport path through which the sheet is transported in a second transporting direction;

a pair of first transporting rollers provided in the first transport path, the pair of first transporting rollers configured to nip a sheet at a nip point between the pair of first transporting rollers and configured to transport the sheet in the first transporting direction;

a recording portion provided downstream of the nip point in the first transporting direction in the first transport path, and including a nozzle that ejects ink droplets;

a platen provided below the recording portion in the first transport path;

a plate-shaped portion positioned at a gap between the recording portion and the platen, wherein the ink-jet recording apparatus is configured to transport the sheet between the plate-shaped portion and the platen, the plate-shaped portion having a free end, in the first transporting direction, also disposed between the recording portion and the platen; and a pair of second transporting rollers provided in the second transport path, the pair of second transporting rollers configured to nip the sheet at a nip point between the pair of second transporting rollers and configured to transport the sheet in the second transporting direction, wherein the second transport path intersects the first transport path at a first connection position and a second connection position, wherein the first connection position is located upstream of the nip point between the pair of first transporting rollers in the first transporting direction, wherein the second connection position is located downstream of the recording portion in the first transporting direction, wherein the second transport path extends toward the first connection position by passing below the platen from the second connection position, wherein the second transport path is a sheet return path through which the sheet is returned to the plate-shaped portion and the recording portion, wherein the second transport path includes a first path defined by a first surface of a guide member and a second path defined by a second surface of the guide member, wherein the second path connects the first path and the first connection position, wherein the first surface extends from a first end of the first surface toward a second end of the first surface along an imaginary straight line below the platen, wherein the second surface extends upward from the second end of the first surface, and wherein when viewed in a rotational axis direction of the second transporting rollers, the nozzle of the recording portion and the free end of plate-shaped portion is positioned between a first imaginary vertical line passing through the first end of the first surface and a second imaginary vertical line passing through the second end of the first surface.

2. The ink-jet recording apparatus according to claim 1, wherein when viewed in the rotational axis direction, the plate-shaped portion does not reach, in the first transporting direction, a third imaginary vertical line which intersects the nip point of the second transporting rollers.

3. The ink-jet recording apparatus according to claim 1, wherein when viewed in the rotational axis direction, the nip point of the pair of first transporting rollers is disposed between the first imaginary vertical line and the second imaginary vertical line.

4. The ink-jet recording apparatus according to claim 1, further comprising a pair of third transporting rollers provided downstream, in the first transporting direction, of the second connection position along the first transport path, and configured to transport the sheet in the first transporting direction, or in the second transporting direction toward the second transport path via the second connection position.

5. The ink-jet recording apparatus according to claim 4, further comprising a path switch portion provided in the second connection position, and configured to contact the sheet transported through the first transport path, to lead an upstream edge of the sheet in the first transporting direction to the second transport path.

6. The ink-jet recording apparatus according to claim 1, wherein an upstream portion of the first transport path in the first transporting direction is defined by a first curved guide member, and wherein a downstream portion of the second transport path in the second transporting direction is defined by a second curved guide member.

7. The ink-jet recording apparatus according to claim 1, further comprising:

a tray provided below the platen and configured to support one or more sheets; and a feeding roller configured to feed the one or more sheets supported by the tray, wherein the second transport path bypasses the feeding roller.

8. The ink-jet recording apparatus according to claim 7, wherein the second transport path passes through above the feeding roller, and wherein, when viewed in the rotational axis direction, the feeding roller is disposed between the first imaginary vertical line and the second imaginary vertical line.

9. The ink-jet recording apparatus according to claim 8, further comprising a feeding arm rotatably supporting the feeding roller, wherein the second transport path passes above the feeding arm.

10. The ink-jet recording apparatus according to claim 1, wherein the first transporting path is parallel to the first path.

11. The ink-jet recording apparatus according to claim 1, wherein the free end of the plate-shaped portion is positioned entirely upstream of the nozzle in the first transporting direction.

12. The ink-jet recording apparatus according to claim 1, further comprising a plurality of plate-shaped portions including multiple ones of the plate-shaped portion, the plurality of plate-shaped portions arranged in a width direction perpendicular to the first transporting direction, wherein the plurality of plate-shaped portions are positioned at a gap between the recording portion and the platen, wherein the ink-jet recording apparatus is configured to transport the sheet between the plurality of plate-shaped portions and the platen, wherein each of the plurality of plate-shaped portions has a free end disposed between the recording portion and the platen, wherein, when viewed in the rotational axis direction, the plurality of free ends of the plurality of plate-shaped portions are disposed between the first imaginary vertical line and the second imaginary vertical line.

* * * * *